US005476135A

United States Patent [19]

Volkmann

[11] Patent Number: 5,476,135

[45] Date of Patent: Dec. 19, 1995

[54] MOLD BOX FOR FORMING SAND POURING BASINS

[76] Inventor: Adolf P. E. Volkmann, 425 NE. 80th, Portland, Oreg. 97213

[21] Appl. No.: 254,553

[22] Filed: Jun. 6, 1994

[51] Int. Cl.[6] ..... B22C 21/00

[52] U.S. Cl. ..... 164/374; 164/237; 249/155; 249/160

[58] Field of Search ..... 164/159, 237, 164/238, 239, 240, 374, 387, 359, 360, 364; 249/155, 160, 117

[56] References Cited

U.S. PATENT DOCUMENTS 3,179,036 4/1965 Luker ..... 249/117 X 3,210,810 10/1965 Potter ..... 164/159

*Primary Examiner*—J. Reed Batten, Jr.

*Attorney, Agent, or Firm*—Eugene M. Eckelman

[57] ABSTRACT

A mold box has a cavity for receiving molding sand. The cavity is defined by the bottom wall of the box, by an outer peripheral wall, and a central part having a top wall disposed in a lowered plane relative to the top wall of the box. Pouring opening shaping discs and rings are releasably supported on the top wall of the central part wherein different shapes and structures of these shaping discs and rings can be substituted one for another to vary the size and shape of the sand basin pouring opening. The discs and rings also are shaped and sized whereby to provide for riser metal for the mold. A sand saver insert is capable of being employed in mold box structures that incorporate waste areas of molding sand.

11 Claims, 4 Drawing Sheets

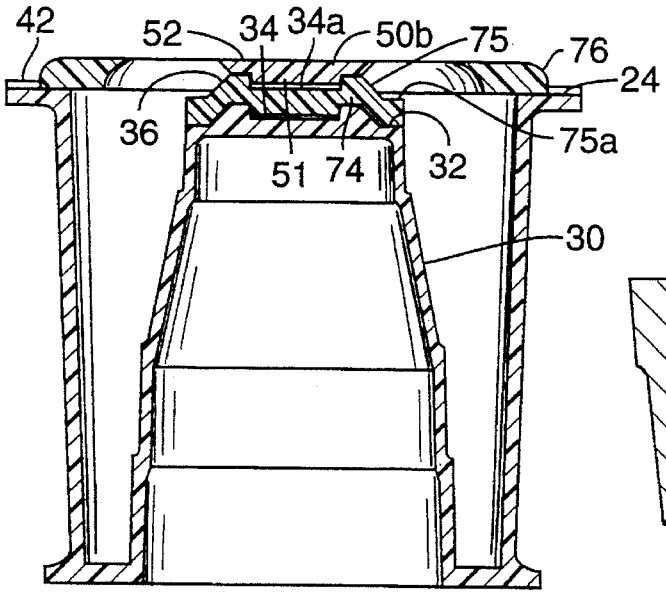
FIG. 7
FIG. 9
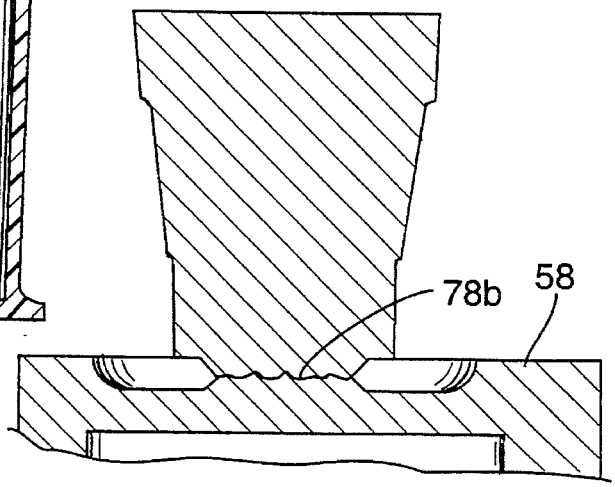
FIG. 8
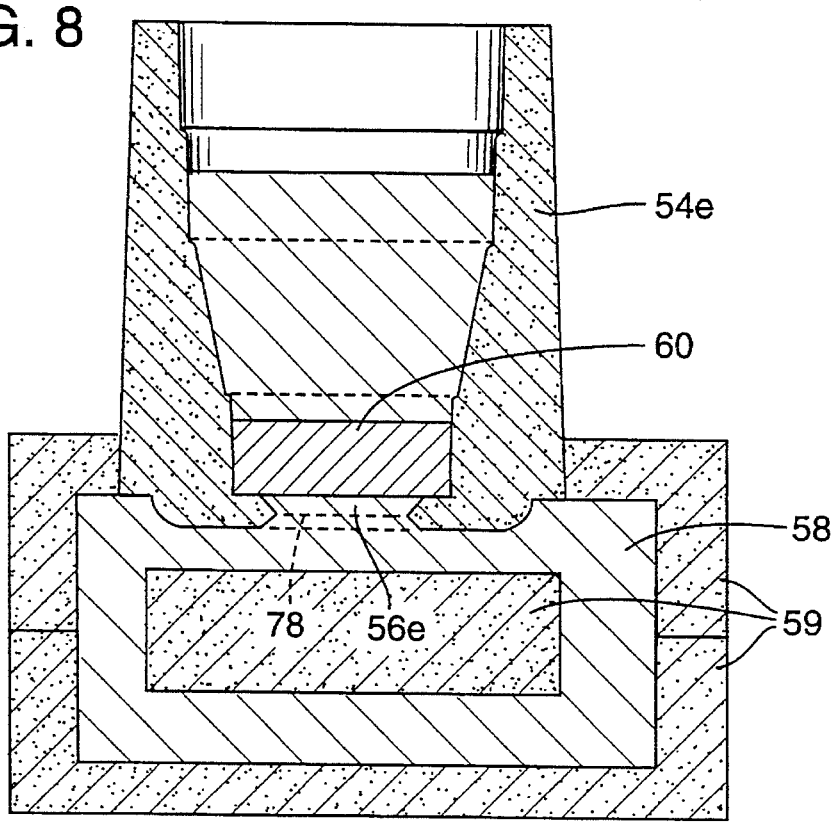

MOLD BOX FOR FORMING SAND POURING BASINS

BACKGROUND OF THE INVENTION

This invention relates to a mold box for forming sand pouring basins.

Foundries use pouring basins for pouring castings such as in cope and drag structures. In the sand molding processes such as air set tooling or no-bake molding system sand processes, sand formed pouring basins are used. These sand formed pouring basins can only be used once. To save costs, foundries make their own sand pouring basins. This is accomplished by the use of mold boxes made of wood. Several requirements are necessary, i.e., pouring basins must be available for different size filters and must provide a pouring area for riser metal. In order to satisfy these various conditions necessary for molding different structures and sizes, multiple pouring basin structures are necessary which means that a multiplicity of wooden molds for such basins must be kept on hand. Coupled with the fact that wooden molds for making sand pouring basins have a short life and also the sand sticks to the interior thereof, the pouring basin system and mold box forming means therefor now used comprise an expensive and cumbersome system.

SUMMARY OF THE INVENTION

A principal object of the invention is to provide a mold box for forming sand pouring basins, said mold box comprising a structure that makes it possible for foundries to make their own sand pouring basins and save considerable time, shipping and handling costs, and mold construction costs in maintaining their own supply of pouring basins.

A more particular object is to provide a mold box of the type described that is made from a lightweight and durable plastic such as polyurethane plastic so as to be of long life and also presents a non-stick molding surface to the molding sand, and that has versatility in accepting different shaping discs and/or rings which provide different pouring openings for pouring casting metal and which convert its use to a filtering or non-filtering basin.

In carrying out these objects a mold box has a top opening cavity for receiving sand to be packed and shaped therein for forming sand pouring basins that are used to direct molten metal into castings. The mold box has a center portion with a top wall disposed in a plane that is lower than the top surface of the mold. Associated with the top wall of the center portion are different shaping means such as discs and/or rings that can be substituted one for another to vary the size and shape of the pouring opening to be formed in the sand pouring basins. Some of the shaping means provide break-off areas for ease of removing excess riser metal. The invention also includes a mold box insert designed to take up waste area of the mold to save the volume of sand used.

The invention will be better understood and additional objects and advantages will become apparent from the following description taken in connection with the accompanying drawings.

BRIEF DESCRIPTION OF THE DRAWINGS

FIG. 7 is a section view of the mold box and showing an embodiment comprising shaping means associated with extension means.

FIG. 8 is a section view showing the basin formed by FIG. 7 in use with a cope and drag structure.

FIG. 9 is a fragmentary section view taken similar to FIG. 8 but showing only casting and riser metal as formed by the basin of FIG. 8.

DETAILED DESCRIPTION OF PREFERRED EMBODIMENTS

Figure 1:
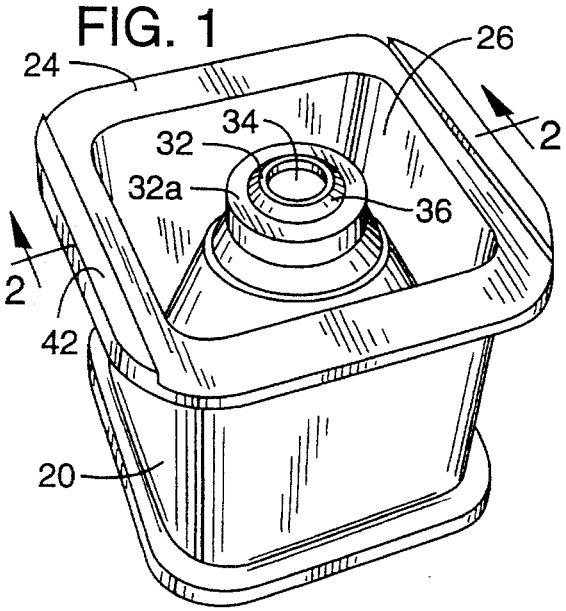
FIG. 1 is a top perspective view of an embodiment of mold box employing principles of the invention.
Figure 2:
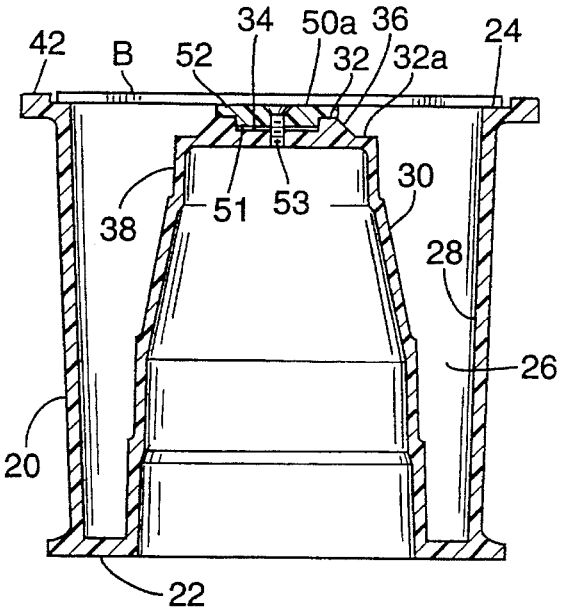
FIG. 2 is a section view of the mold box taken on the line 2—2 of FIG. 1, this view showing a first form of pouring opening shaping means used with the box.

With particular reference to the drawings, and first to FIGS. 1 and 2, a mold box embodiment of the invention is represented generally by the reference numeral 20. Important to the invention, it comprises a molded structure of lightweight durable plastic that can be used repeatedly for forming sand pouring basins. A polyurethane plastic adequately serves to provide a substantially permanent mold box. Also, its plastic construction provides non-stick surfaces for molding sand.

The mold box of FIGS. 1 and 2 has a flat bottom surface 22 and a flat top surface 24. A mold cavity 26 opens through the top surface 24, this surface comprising the mold parting line. The cavity is defined by an outer wall surface 28 and the surface of a tapered center part of the box 30. The center part 30 has a top surface 32 that is disposed in a plane lower than the plane of the top surface 24. The amount of this lowered plane may vary according to the size of the box but as an illustration, in a cavity width of 16 centimeters at the top, the surface 32 has approximately 1 centimeter distance below the surface 24. The center of surface 32 has a recess 34 which is associated with interchangeable shaping discs, to be described, that are used to vary the size and shape of the pouring opening of the basins to be molded. An outer portion 32*a* of the surface 32 is lowered relative to the latter surface and an inclined surface 36 extends between these two surfaces. An upper end of the outer wall surface of the center part 30 has a reduced diameter, straight wall portion 38. This reduced portion, as will be seen hereinafter, forms a socket 40 for a filter in the molded article, to be described. Opposite side transverse abutment dump out strips 42 are provided on the top surface 24 of the mold box. When the molded article is to be removed from the mold, the hold is inverted and tapped on a stationary surface. The recessed top surface 24 allows the molded box to loosen from the mold.

Interchangeable shaping discs and rings associated with the mold box 20 are provided that take various structural forms to make desired pouring opening shapes and sizes as required by the foundry whereby a multiplicity of mold boxes are not necessary. With reference first to FIG. 2 a first form of shaping disc 50*a* is shown mounted on top of the center part 30 of the box. This shaping disc, as well as all the other discs of different embodiments, to be seen, has a central depending locating projection 51 of a size that fits snugly in the recess 34. This particular shaping disc has a head portion 52 the underside of which, outwardly of the projection 51, seats on the top surface 32 of the center part 30 of the box. The peripheral edge of the head portion 52 terminates at the top of taper 36 of the center part 30 of the box. The top surface of disc 50*a* is flush with the parting line of the mold, namely, flush with the top surface 24 of the box. A hold-down screw 53 is mounted in the disc to hold it in place when molding. For forming a pouring basin, molding sand is packed in the mold cavity 26 with the cap 50*a* secured in place. After filling the cavity, the top surface 24 serves as a support surface for a strike off bar B.

Figure 3:
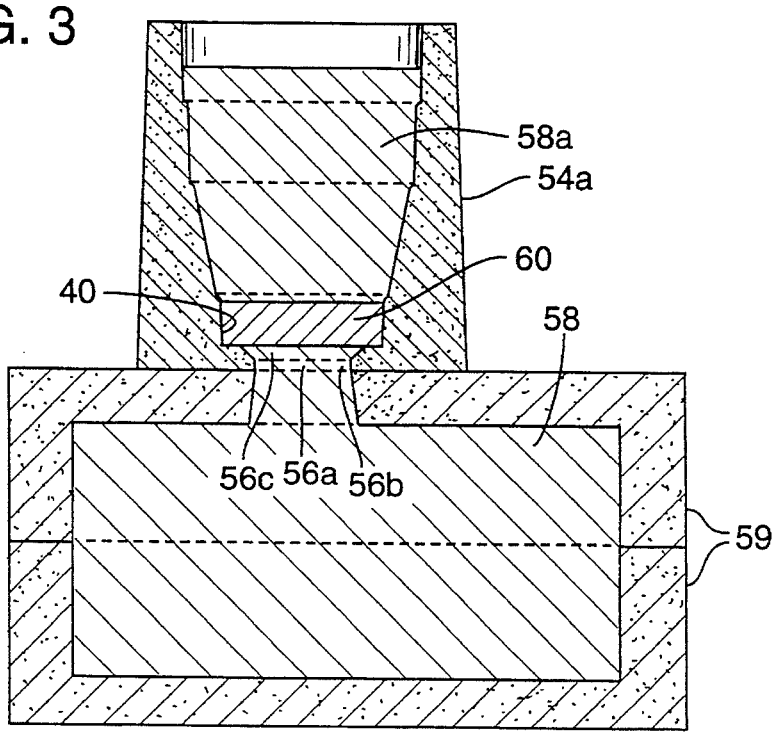
FIG. 3 is a section view of a sand pouring basin formed by the mold box using the pouring opening shaping means of FIG. 2, this view showing the basin in its upright position and associated with a casting and cope and drag structure.

To remove the molded basin from the box after curing of the sand and after the cap 50*a* is removed, the box is inverted and tapped against a stationary surface to loosen the basin that has been formed therein. The basin thus formed and positioned upright for use is designated by 54*a* in FIG. 3 and the pouring opening 56*a* of this basin takes the shape as shown. In this embodiment the pouring opening 56*a* comprises a circular straight walled outlet portion 56*b* and an enlarging upper tapered portion 56*c*. The opening 56*a* serves to transfer molten metal from the basin to a casting 58 in a cope and drag structure 59. The metal is poured to form riser metal 58*a* that accommodates shrinkage of metal in the casting as the metal sets. After the metal has set, the sand basin is knocked off and the riser metal is removed as by grinding. A filter 60 may or may not be used, as required by circumstances.

Figure 4:
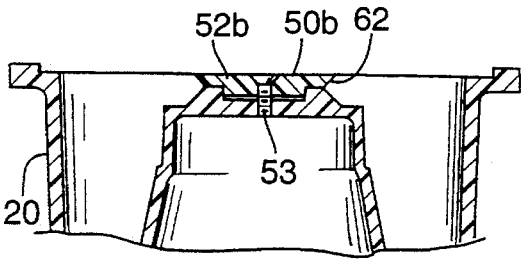
FIGS. 4, 5 and 6 are fragmentary section views taken similar to FIG. 2 showing other forms of pouring opening shaping means.
Figure 4A:
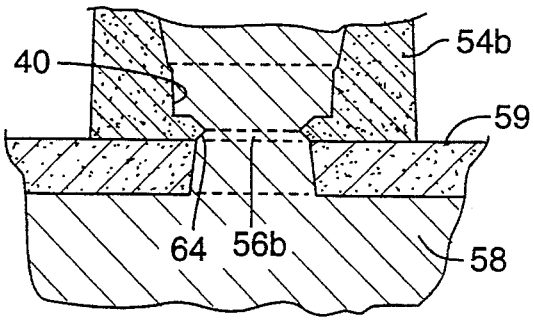
FIGS. 4A, 5A, and 6A are fragmentary section views taken similar to FIG. 3 and showing the pouring openings formed by the pouring opening shaping means of FIGS. 4, 5 and 6, respectively.

Another form of disc 50*b* and the shaping function thereof for forming a different pouring opening are shown in FIGS. 4 and 4A, respectively. This disc has a structure similar to disc 50*a* of FIG. 2 except that the underside 62 of the top enlarged portion 52*b* tapers upwardly and outwardly to an outer sharpened edge. The pouring opening 56*b* thus formed in the basin 54*b* includes an inwardly directed restriction 64. After pouring the metal in the mold as well as an excess in the basin as a riser, and after setting of the metal, restriction 64 serves as a break-off area of the riser for convenience in removing a good share of the riser metal. This embodiment of basin may be used with or without a filter.

Figure 5:
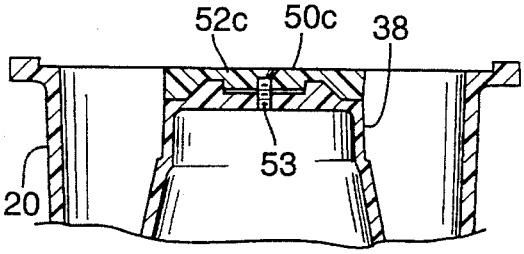
Figure 5A:
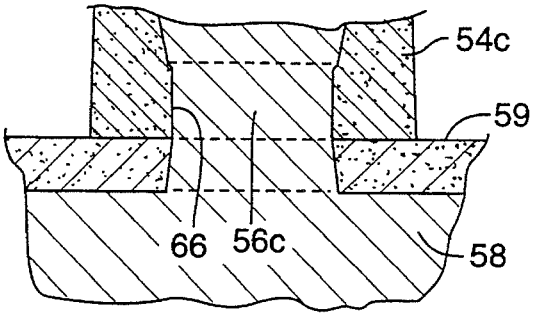

With reference to FIGS. 5 and 5A, another example of disc, designated by the reference numeral 50*c*, may be used for forming a pouring opening 56*c* in the basin 54C. The cap 50*c* is similar to the cap 50*a* but the head portion 52*c* is larger and extends fully the width of the top reduced portion 38 of the center part 30 of the mold. As apparent in FIG. 5A, pouring opening 56*c* is enlarged relative to the openings of previous embodiments and has straight wall portions 66. This pouring opening, being substantially enlarged, forms an enlarged or full riser portion in molding situations wherein considerable shrinkage may occur and excess riser metal is needed.

Figure 6:
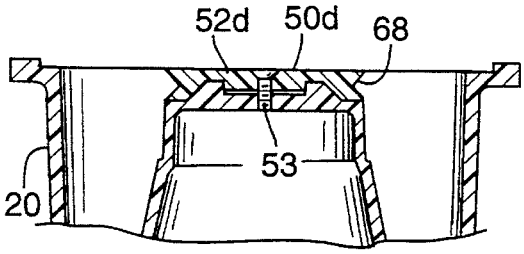
Figure 6A:
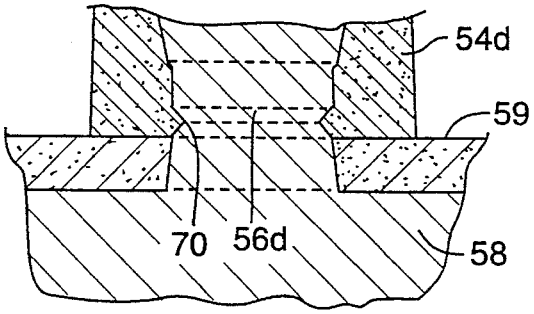

FIGS. 6 and 6A show a still further form of disc 50*d* and resulting pouring opening 56*d* in FIG. 6A. This disc is widened similar to the embodiment of FIG. 4 but includes a horizontal V-shaped annular groove 68 in its side wall between its top and bottom surfaces that forms a break-off area 70 in the basin 54*d*. This break-off area reduces the labor necessary to grind or otherwise remove metal that sets up in the pouring opening.

Further enlargement of the pouring opening can be accomplished by other forms. For example, reference is directed to FIG. 7 wherein one of the discs 50*b* is the same as that shown in FIG. 4 but is supported and centered in an elevated position above the top of the center part 30 by an extension ring 74. This ring has a bottom contour centrally thereof the same as other embodiments whereby to seat on the recessed top surface 32*a*, 34 and 36 of the center part 30. The top surface of this ring has a center recess 34*a* to receive the disc 50*b* and its outside surface 75 angles into the bottom of the head 52 of disc 50*b* outwardly of and engaged against the depending projection 51. Surface 75 includes a step 75*a* that forms a filter support shoulder in a basin made from this box. This assembly uses an outer extension plate 76 that extends the bottom of the basin, FIG. 8, into the mold cavity. The extension plate is supported on the top surface 24 of the mold box and positioned between the dump out strips and the striking surface for removing excess sand now comprises the top of the ring 76. The sand basin 54*e* formed thereby has a pouring opening 56*e* as shown in FIG. 8 with a restriction 78 that forms a break-off area. In the molded metal form of FIG. 8 the break-off line 78*b* is below the one surface of the casting 58, FIG. 9, and eliminates the necessity of finishing off riser metal. This form can be used where this rough surface is not objectionable.

Figure 10:
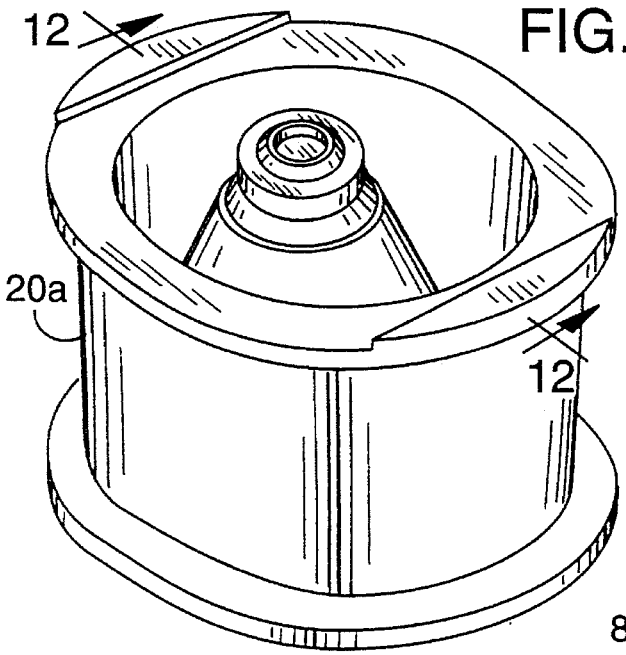
FIG. 10 is a top perspective view of a mold box of the invention constructed to form a particular shape of basin.
Figure 11:
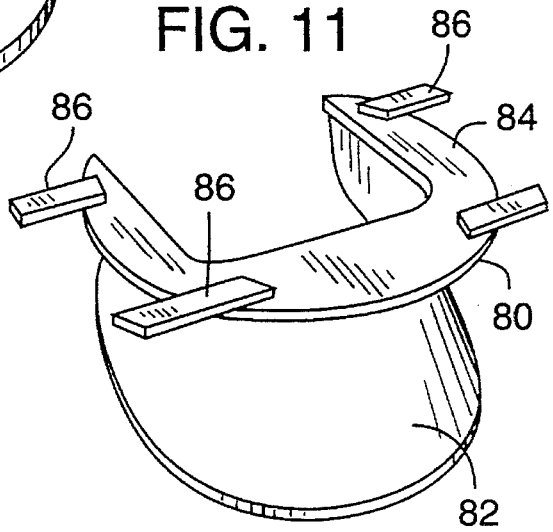
FIG. 11 is a perspective view of a sand saver insert used with the mold box of FIG. 10.
Figure 12:
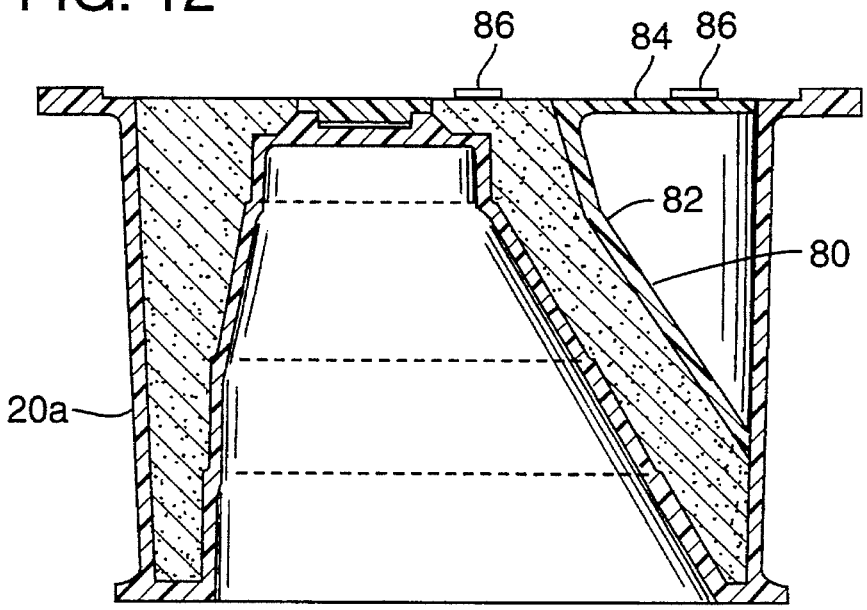
FIG. 12 is a section view of the mold box of FIG. 10 with the sand saver in place, taken on the line 12—12 of FIG. 10.

FIGS. 10–12 illustrate a sand saver structure that can be used with embodiments of the invention. In some sand pouring basin forms, the mold box 20*a* of necessity must be formed with large inner areas which are wasted space and require the use of a considerable quantity of sand. To avoid the waste of sand, a space saver insert 80 is provided that is contoured with an upright wall 82 that defines a portion of the cavity but fills in the waste area of the mold. The insert includes a top wall flange 84 that has supporting and locating tabs 86 engageable with the mold top. As evident from FIG. 12, the insert is shaped to block off waste area. It thus saves considerably on the amount of sand used, The mold box of the invention can be applied to multiple cavity molds.

The present mold box is for making pouring, filtering and/or riser basins and has great versatility for foundries that use sand castings. The box is light in weight and can be used for long periods of time without the necessity of replacement. The bottom opening can be varied in size and shape by the use of loose adapter shaping means. Break-off lines can be made in the riser metal to minimize the work necessary to finish the casting. Further, the mold box can easily be converted to a recessed breakoff riser basin. Each mold box is designed to accommodate one filter size and may be used with or without a filter. Thus, foundries can make the inexpensive sand pouring basins to save the expense of using short lived wood boxes and to save time as well as shipping and handling costs.

It is to be understood that the forms of my invention herein shown and described are to be taken as preferred examples of the same and that various changes in the shape, size and arrangement of parts may be resorted to without departing from the spirit of my invention, or the scope of the subjoined claims.

Having thus described my invention, I claim:

1. A device for forming a sand pouring basin having a container portion for receiving molten metal and also having a bottom pouring opening for discharge of the molten metal into a mold, said device comprising:

a mold box having a cavity for receiving sand to be packed and shaped, said cavity being defined by a bottom wall of said mold box, an outer peripheral wall having a top surface, and a central part spaced from said outer peripheral wall and having a wall surface that forms said cavity with said outer wall, the top of said cavity being open for packing sand therein, said central part having a top wall disposed in a lowered plane relative to the plane of the top surface of said peripheral wall, and pouring opening shaping means supported in projecting relation on the top wall of said central part to form a bottom pouring opening for the pouring basin at said lowered plane, said shaping means being releasably supported on said top wall wherein selected shaping means can be substituted one for another to vary the size and shape of the pouring opening.

2. The device of claim 1 wherein said top wall of said central part includes a recess and said shaping means includes a depending projection engageable with said recess for positioning said shaping means.

3. The device of claim 1 wherein said shaping means has a thickness sufficient to form a pouring opening in the basin with excess molten metal for riser purposes.

4. The device of claim 3 wherein said shaping means has a shape to form an inwardly directed groove in the excess molten riser metal wherein a portion of said riser metal can be broken off for ease of removal of excess riser metal after the molten metal has set.

5. The device of claim 1 wherein said shaping means includes extension means supported on the top wall of said center part and on said top surface of said mold box to increase the size of said pouring opening.

6. The device of claim 5 wherein said shaping means includes a first cavity-defining extension plate removably supported on the top surface of said mold box for increasing the depth of the basin, a pouring opening extension member disposed centrally of said central part, and an extension ring supported on the top wall of said core in turn supporting said central extension plate in the plane of said extension ring.

7. The device of claim 1 wherein the wall surface of said central part forms a seating area on the interior of said basin for supporting a filter.

8. The device of claim 1 wherein the top surface of said mold box includes a support.

9. A device for forming a sand pouring basin having a container portion for receiving molten metal and also having a bottom pouring opening for discharge of the molten metal into a mold, said device comprising:

a mold box having a cavity for receiving sand to be packed and shaped, said cavity being defined by a bottom wall of said mold box, an outer peripheral wall having a top surface, and a central part spaced from said outer peripheral wall and having a wall surface that forms said cavity with said outer wall, the top of said cavity being open for packing sand in the cavity, said central part having a top wall disposed in a lowered plane relative to the plane of the top surface of said peripheral wall, and interchangeable means on the top wall of said central part that can form a bottom pouring opening for the pouring basin and that can be substituted one for another to vary the size and shape of the pouring opening.

10. The device of claim 9 that is constructed of a durable plastic for repeated use.

11. The device of claim 9 including an insert removably fitted in said cavity, said insert including a hollow body member of a volume which fills a portion of said cavity wherein to save on the amount of sand necessary to be packed in said cavity.

* * * * *